US005498452A

United States Patent [19]

Powers

[11] Patent Number: 5,498,452

[45] Date of Patent: Mar. 12, 1996

[54] DUAL OVENABLE FOOD CONTAINER

[75] Inventor: Thomas J. Powers, West Monroe, La.

[73] Assignee: J.D. Cahill Company, Inc., Hampton, N.H.

[21] Appl. No.: 219,731

[22] Filed: Mar. 28, 1994

Related U.S. Application Data

[63] Continuation of Ser. No. 919,017, Jul. 23, 1992, abandoned.

[51] Int. Cl.[6] ..... B32B 27/10

[52] U.S. Cl. ..... 428/34.2; 428/35.7; 428/36.91; 220/454; 220/458; 220/461; 220/462

[58] Field of Search ..... 428/34.1, 34.2, 428/35.7, 36.6, 36.7, 36.91, 507, 511, 512, 513, 514; 220/454, 458, 461, 462

[56] References Cited

U.S. PATENT DOCUMENTS

| | | | |
|---|---|---|---|
| 2,889,299 | 6/1959 | Ritson | 260/29.6 |
| 3,790,520 | 2/1974 | Ludwig | 260/29.6 E |
| 4,007,147 | 2/1977 | Leeson et al. | 260/29.4 |
| 4,021,397 | 5/1977 | Shah | 260/29.6 N |
| 4,421,825 | 12/1983 | Seiter | 428/332 |
| 4,543,280 | 9/1985 | Fujita et al. | 428/35 |
| 4,595,611 | 6/1986 | Quick et al. | 428/35 |
| 4,737,389 | 4/1988 | Hartsing, Jr. et al. | 428/36.6 |
| 4,757,940 | 7/1988 | Quick et al. | 229/3.5 R |
| 4,900,594 | 2/1990 | Quick et al. | 428/34.2 |
| 4,933,216 | 6/1990 | Filbert et al. | 428/34.1 |

FOREIGN PATENT DOCUMENTS

| | | |
|---|---|---|
| 0407059A | 9/1991 | European Pat. Off. . |
| 1593331 | 7/1981 | United Kingdom . |
| 8202184 | 7/1982 | WIPO . |

OTHER PUBLICATIONS

Hawley's Condensed Chemical Dictionary, 1993, p. 325.
Saunders, Organic Polymer Chemistry, 1988, p. 62.

*Primary Examiner*—James J. Seidleck
*Assistant Examiner*—Michael A. Williamson
*Attorney, Agent, or Firm*—Thomas V. Smurzynski; William C. Geary, III; Lahive & Cockfield

[57] ABSTRACT

A dual ovenable food product container is formed from a coated or uncoated paperboard substrate to which is applied a precoat layer and a topcoat layer. The precoat is formed from an aqueous emulsion copolymer such as ethylene vinyl acetate while the top coat is formed from and aqueous emulsion which is a copolymer of one or a mixture of styrenated acrylic copolymers. The $T_g$ of the precoat should be in the range of 0° C. to 25° C., while the $T_g$ of the top coat layer is in the range of about 10° C. to 60° C.

15 Claims, No Drawings

DUAL OVENABLE FOOD CONTAINER

This application is a continuation of application Ser. No. 07/919,017 filed on Jul. 23, 1992 now abandoned.

BACKGROUND OF THE INVENTION

The invention relates to polymer coated paperboard products, and more particularly to dual ovenable paperboard products.

Many food items are precooked and frozen for long term storage before cooking. In the past foods were often packaged in aluminum cooking trays. Such containers have become less popular with the increasing popularity of microwave ovens since metal containers cannot normally be used for microwave cooking. There is now a desire in the industry to package frozen and prepare foods in containers which are dual ovenable, that is able to be used in both microwave and conventional ovens.

Paperboard-based containers have thus become widely used as containers for prepared foods. Such materials offer the advantages of being microwavable as well as suited for use in conventional ovens. In some instances, however, plain paperboard is not able to be exposed to temperatures typically encountered during cooking. Certain polymer based coatings have been developed for application to paperboard to reduce the charrability of the container.

One commonly used coating is a polyester material. This contributes moderate heat stability to the paperboard so that it is able to resist charring up to about 400° F.(203° C.). One disadvantage of this material is that it can be difficult to recycle and thus may raise environmental concerns. Further, the use of polyester coatings is relatively expensive and does not afford ideal heat stability as paperboard coated with polyester can warp during heating.

U.S. Pat. No. 4,421,825 discloses a paperboard product coated with a first layer which includes titanium dioxide, a second layer of an acrylic copolymer and an organic solvent, and one or more outer layers comprising a clear acrylic copolymer also dissolved in an organic solvent. Paperboard to which such coatings have been applied are reported to be able to resist charring at temperatures up to 205° C. (approximately 400° F.). However, the coating process can present environmental problems because the organic solvent is volatized during the drying process. The use of a titanium dioxide pigment in the first coating can also reduce the aesthetics of the resulting food as the pigmented coating tends to be brittle and staining can result in areas where the container has been folded or scored.

It would thus be advantageous to provide coated paperboard products which have high temperature stability and which offer ease of manufacture.

Accordingly, it is an object of the invention to provide a dual ovenable food container manufactured from a paperboard substrate. A further object is to provide a paperboard food container coated with one or more aqueous based polymer emulsions which enable the paperboard product to be used effectively at temperatures in the range of 450° to 500° F. (232° C. to 260° C.). Another object of the invention is to provide a polymer coated paperboard product, the manufacture of which can minimize environmental dangers. Other objects of the invention will be apparent upon reading the following description.

SUMMARY OF THE INVENTION

The present invention provides a dual ovenable food product container which is formed from a paperboard substrate. The substrate can be uncoated, or it can have coated on at least one surface thereof a clay based material, such as a kaolin clay. A copolymer precoat is disposed over the clay based coating of the paperboard substrate and upon drying, a copolymer top coat is applied over the precoat. The precoat preferably is a copolymer aqueous emulsion which is formed from an aliphatic or aromatic vinyl monomer and one or more comonomers selected from acrylic esters, vinyl nitriles, and olefins having from 1 to 8 carbon atoms, wherein the $T_g$ of the polymeric emulsion is in the range of 0° C. to 25° C. The overcoat layer is comprised of one or a mixture of styrenated acrylic polymers formed from an aqueous emulsion wherein the $T_g$ of the overcoat is in the range of 10° C. to 60° C.

Among the advantages of the dual ovenable food product container of the invention is the ability of the product to resist browning up to 450° F. (232° C.) and to resist charring at temperatures in the range of 450° to 500° F. (232° C. to 260° C.). Moreover, paperboard substrate coated according to the present invention presents few environmental hazards.

DETAILED DESCRIPTION OF THE INVENTION

The polymer coated paperboard substrate of the invention is useful as a dual ovenable food container able to be used in temperature range as high as 450° to 500° F. (232° to 260° C.) without exhibiting any significant charring, and only with slight browning in this temperature range. Generally, the substrate material is a grade of paperboard suitable for use with food products. The substrate preferably has coated on at least one side thereof a clay-based material which serves as a barrier for water, grease and other coatings. However, a clay coating is not essential. Two additional, separate coatings are applied to the substrate (over the clay coating if present) to impart resistance to temperatures typically encountered during cooking. The coated paperboard of the invention is suitable for use in storing both frozen and prepared foods which require cooking or preheating by either conventional or microwave ovens prior to consumption.

The paperboard substrate suitable for use with the invention can be solid bleached substrate or solid unbleached substrate. An exemplary substrate is cupstock. This material need not be precoated but preferably is precoated with a clay material such as kaolin clay, or with other materials including calcium carbonate and titanium dioxide. The coating can be adhered to the substrate by polymer or protein based binders including, but not limited to, vinyl acetate and caesin. One suitable commercially available substrate, precoated with a clay based material, is clay coated cupstock manufactured by companies including Potlatch Corporation, Georgia Pacific, and International Paper. Other suitable materials include coated two side solid bleached substrate supplied by Gulf States Paper, Gilman Paper, or Tembec.

A first polymer coating applied to the clay based coating on the substrate is an aqueous emulsion copolymer. The copolymer preferably is formed from an aliphatic or aromatic vinyl monomer and one or more comonomers selected from the group consisting of esters of alphamethylene aliphatic monocarboxylic acids, vinyl nitriles and olefins having from 1 to 8 carbon atoms. Alphamethylene aliphatic monocarboxylic acid esters include methyl acrylate, ethylacrylate, ethyl hexyl acrylate, propyl acrylate, n-butylacrylate, isobutylacrylate, n-octylacrylate, dodecylacrylate, 2-chloroethylacrylate, methylalpha-chloroacrylate, methylmethacrylate, and the like. Preferably, the vinyl monomers include styrene and vinyl acetate. Preferred comonomers include butyl acrylate, acrylonitrile, ethylene and butadiene. The copolymer used as the precoating layer preferably has a $T_g$ in the range of 0° C. to 25° C. Preferred precoat copolymers include styrene butadiene, butyl acrylate, acrylonitrile styrene butylacrylate, and ethylene vinyl acetate. A most preferred copolymer is ethylene vinyl acetate wherein the percentage of vinyl acetate is in the range of 50 percent to 80 percent vinyl acetate, and having a viscosity in the range of 200 to 300 cps. A commercially available ethylene vinyl acetate is Air Flex 100 HS available from Air Products & Chemicals, Inc.

As noted, it is not necessary that a coating of clay or other materials be present on the paperboard substrate. When such a coating is not present the precoat aqueous emulsion copolymer can be applied directly to the uncoated substrate.

The top coating which is applied over the copolymer precoat is likewise an aqueous emulsion copolymer. Preferably, the top coating is formed from a styrenated acrylic copolymer. This acrylic copolymer preferably is a latex formulation which may be formed from monomers including acrylic acid, methylacrylic acid, esters of these acids, and acrylonitrile. The pH of this coating is preferably in the range of 2.5 to 5.0, but may be adjusted as required for processing. The glass transition temperature of the acrylic copolymer coating ranges from about 10° C. to 60° C.

More preferably, the top coat is a mixture of two styrenated acrylic copolymers, one of which possesses relatively high hardness while the other is of moderate hardness. Commercially available acrylic copolymers which can be combined to form the top coat layer include HYCAR 26315 and HYCAR 26288, both of which are available from B. F. Goodrich Company, Specialty Polymers and Chemicals Division, Cleveland, Ohio. The two preferred acrylic copolymers are acrylic copolymer latex formulations. The HYCAR 26315 copolymer is a relatively hard copolymer having a $T_g$ of approximately 55° C. whereas the HYCAR 26288 copolymer is of moderate hardness having a $T_g$ of approximately 20° C. In a preferred embodiment, the top coating would include approximately 40 to 80 percent of HYCAR 26315 and approximately 60 to 20 percent of HYCAR 26288. In a more preferred embodiment, the top copolymer coating includes approximately 60% HYCAR 26315 and approximately 40% HYCAR 26288.

While HYCAR copolymers are mentioned as preferred acrylic copolymer top coatings, it is understood that other acrylic copolymers having similar properties may likewise be used.

The top coating preferably is one which is crosslinked. To facilitate the crosslinking of the acrylic copolymer overcoat layer, a crosslinking agent, such as melamine formaldehyde, can be added to the copolymer blend before coating upon the substrate. The crosslinking agent may be added in an amount ranging from approximately ½ to 10% by weight and most preferably at about 3 to 6% by weight.

The combined thickness of the precoat and top coat layer is less than or equal to about 0.5 mil. The precoat typically ranges in thickness from 0.05 to 0.4 mil and the top coat thickness generally ranges from about 0.25 to 0.4 mil. Moreover, the combined coatings preferably are applied at 1 to 5 lbs per thousand square foot and most preferably at about 1 to 3½ lbs per thousand square foot. The precoat preferably is applied at about 1–2 lbs/1000 s.f. and the topcoat preferably is applied at about 2–3 lbs./1000 s.f.

The dual ovenable container of the invention can be formed as follows. An aqueous emulsion, such as Air Flex—100 HS ethylene vinyl acetate copolymer is prepared as an aqueous emulsion. If necessary, the copolymer is diluted with water to achieve a viscosity in the range of about 200 to 300 cps. This copolymer is then applied at room temperature upon the clay coated surface of a paperboard substrate by a gravure coating process. Other coating techniques suitable for applying water-based coatings, include rod coating, air knife coating, and blade coating.

The precoat is then dried at about 150° C. to 315° C. (300° F. to 600° F.), preferably by infrared heating. Thereafter an acrylic copolymer aqueous emulsion such as a 60/40 blend of HYCAR 26315 and HYCAR 26288 is applied as a top coat. Preferably the acrylic copolymer topcoat includes approximately about 3% of a crosslinking agent such a melamine formaldehyde. The topcoat layer preferably is applied to the dry precoat by rod application. Alternatively, other coating techniques such as gravure, blade, and air knife coating can also be used. The top coat is dried at about 204° C. (400° F.) through the application of hot air. Crosslinking of the copolymer also occurs during the drying process.

In a preferred embodiment the coating of the paperboard takes place on an automated coating line. The substrate upon which the coatings are to be applied is run through the line at about 300 to 400 feet per minute. Once the precoat is applied, it is passed under a series of infrared lamps for drying. Thereafter, the topcoat is applied and the material enters a drying tunnel of about 60 feet in length where the topcoat is dried by the application of hot air. Typical residence time in the topcoat dryer is approximately 5 to 8 seconds.

Exemplary coatings which can be used to form the precoat layer include the following aqueous emulsions:

ethylene vinyl acetate ($T_g$ 5° C., over 50% vinyl acetate)

styrene butadiene ($T_g$ 0.5° C., about 50–70% styrene), e.g., BASF Styronal® 4430.

n-butyl acrylate acrylonitrile styrene ($T_g$ 11° C., 10–20% acrylonitrile, 30–40% styrene)

styrene butyl acrylate ($T_g$ 22° C., 50–80% styrene)

HYCAR 26288/HYCAR 26315 (70–0% HYCAR 26288)

The following example serves to further illustrate the invention.

EXAMPLE

A dual ovenable paperboard product was prepared by applying the precoat and top coat aqueous polymer emulsions of the present invention upon a kaolin clay coated surface of a cupstock substrate. The precoat applied to the surface comprised an ethylene vinyl acetate aqueous emulsion copolymer (Air Flex 100 HS, Air Products and Chemicals, Inc.,), while the topcoat included a 60/40 blend of HYCAR 26315 and HYCAR 262288 with 5% by weight melamine formaldehyde. The precoat was applied at about 1–1.5 lbs/1000 s.f. and the topcoat was applied at about 2.25–2.5 lbs/1000 s.f. A variety of prepared foods were placed in containers constructed from the coated paperboard product as described above, and frozen. Thereafter the food was cooked, either conventionally or in a microwave, for the noted time intervals at the noted temperature or microwave power. The effect of any possible browning or charring was observed and the data is shown below in Table 1. Browning is defined as any noticeable discoloration of the coating or paperboard surface. Charring is defined as a significant discoloration and/or oxidation of the board surface.

TABLE 1

HEAT STABILITY DATA

| Sample | Food | Temp/ Power | Time | Observations |
|---|---|---|---|---|
| 1-C | Macaroni & cheese | 175° C. | 25 min. | Excellent, no charring or browning, good food release |

TABLE 1-continued

HEAT STABILITY DATA

| Sample | Food | Temp/ Power | Time | Observations |
|---|---|---|---|---|
| 1-M | Macaroni & cheese | 700 W (high) | 6 min. | Excellent, no charring or browning, good food release |
| 2-C | Chicken & noodles | 190° C. | 30 min. | Excellent, slight browning, no charring |
| 2-M | Chicken & noodles | 700 W | 7 min. | Excellent, no browning or charring |
| 3-C | Lasagna | 205° C. | 45 min. | Excellent, slight browning, no charring |
| 4-C | Lasagna | 230° C. | 45 min. | Excellent, no browning where food contacts container, slight browning with exposed portions of board, no charring |
| 5-C | Lasagna | 260° C. | 40 min. | Satisfactory, food surface began to char, moderate browning of exposed paperboard |
| 6-C | Vegetables with cheese | 190° C. | 30 min. | Excellent, no browning or charring |
| 6-M | Vegetables with cheese | 700 W | 4 min. | Excellent, no browning or charring |
| 7-C | Fish with sauce | 175° C. | 30 min. | Excellent, no browning or charring |
| 7-M | Fish with sauce | 700 W | 4 min. | Excellent, no browning or charring |
| 8-C | Salisbury Steak | 190° C. | 30 min. | Excellent, no browning or charring |
| 8-M | Salisbury Steak | 700 W | 7 min | Excellent, no browning or charring |
| 9-M | Beef with gravy, corn, potato (3 compartment tray) | 205° C. | 35 min. | Excellent, slight browning in exposed areas, no charring |
| | Beef with gravy, corn, potato (3 compartment tray) | 700 W | 8 min. | Excellent, slight browning in exposed areas, no charring |

* A "C" following a sample number donates cooking in a conventional oven while an "M" denotes cooking in a microwave oven.

It is understood that various modifications can be made to the invention without departing from the intended scope of the invention.

What is claimed is:

1. A dual ovenable food product container, consisting essentially of:

a paperboard substrate;

a precoat, disposed over a surface of the substrate, consisting of a copolymerized aqueous emulsion formed from an aliphatic vinyl monomer or an aromatic vinyl monomer and one or more comonomers selected from the group consisting of acrylic esters, vinyl nitriles, and olefins having from 1–8 carbon atoms wherein the $T_g$ of the copolymerized aqueous emulsion is in the range of 0° C.–25° C.;

an overcoat, food contacting layer, disposed on the precoat layer, comprising one or a mixture of crosslinked styrenated acrylic copolymers formed from an aqueous emulsion, wherein the $T_g$ of the overcoat layer is in the range of 10° C. to 60° C. and the combined thickness of the precoat and overcoat layers is less than or equal to 0.5 mil;

the container, precoat and overcoat layers disposed thereon being able to resist browning at temperatures up to above 232° C. and to resist charring at temperatures in the range of about 232° C. to 260° C.

2. The container of claim 1 wherein the precoat layer is selected from the group consisting of styrene butadiene, butylacrylate acrylonitrile styrene, styrene butylacrylate, and ethylene vinyl acetate.

3. The container of claim 1 wherein the precoat layer is an ethylene vinyl acetate copolymer having between 50 and 80 wt % vinyl acetate.

4. The container of claim 1 wherein the precoating layer thickness ranges from about 0.05 to 0.4 mil.

5. The container of claim 4 wherein the overcoat layer thickness ranges from about 0.2 to 0.5 mil.

6. The container of claim 5 wherein the precoat layer is applied to the paperboard substrate at about 2 lbs/1000 square feet.

7. The container of claim 6 wherein the overcoat layer is applied to the precoat layer at 2 to 3 lbs/1000 s.f.

8. A dual ovenable food product container, consisting of:

a paperboard substrate having a clay-based coating on at least one surface thereof;

a precoat, disposed over the clay-based coating formed from a copolymerized aqueous emulsion, selected from the group consisting of ethylene vinyl acetate, styrene butadiene, butylacrylate acrylonitrile styrene, and styrene butylacrylate, wherein the $T_g$ of the polymeric emulsion is in the range of 0° C. to 10° C.; and an overcoat, food contacting layer, disposed on the precoat layer, comprising one or a mixture of styrenated acrylic copolymers formed from an aqueous emulsion, having a $T_g$ in the range of 10° C. to 55° C. and the precoat and overcoat layers having a combined thickness of less than or equal to 0.5 mil;

the container, precoat and overcoat layers disposed thereon being able to resist browning at temperatures up to about 232° C. and to resist charring at temperatures in the range of 232° C. to 260° C.

9. The container of claim 8 wherein the precoat layer is an ethylene vinyl acetate copolymer having between 50 and 80 wt % vinyl acetate.

10. The container of claim 8 wherein the precoating layer thickness ranges from about 0.05 to 0.5 mil.

11. The container of claim 9 wherein the overcoat layer thickness ranges from about 0.2 to 0.5 mil.

12. The container of claim 11 wherein the precoat and overcoat layers are applied to the paperboard substrate are about 1.5 to 3.5 lbs/1000 square feet.

13. The container of claim 12 wherein the overcoat layer is applied to the precoat layer at about 2 to 3 lbs/1000 square feet.

14. The container of claim 12 wherein the clay-based coating is a kaolin clay.

15. The container of claim 8 wherein the overcoat layer is a crosslinked styrenated acrylic copolymer.

* * * * *